US009662921B2

(12) United States Patent
Sugiura et al.

(10) Patent No.: US 9,662,921 B2
(45) Date of Patent: May 30, 2017

(54) RECORDING MEDIUM

(71) Applicant: CANON KABUSHIKI KAISHA, Tokyo (JP)

(72) Inventors: Takashi Sugiura, Yokohama (JP); Shinya Yumoto, Kawasaki (JP); Naotoshi Miyamachi, Tokyo (JP); Tetsuro Noguchi, Hachioji (JP); Hisao Kamo, Ushiku (JP); Kazuhiko Araki, Kawasaki (JP); Ryo Taguri, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/057,367

(22) Filed: Mar. 1, 2016

(65) Prior Publication Data

US 2016/0257156 A1 Sep. 8, 2016

(30) Foreign Application Priority Data

Mar. 2, 2015 (JP) ..... 2015-040473
Mar. 2, 2015 (JP) ..... 2015-040474
Feb. 22, 2016 (JP) ..... 2016-031239

(51) Int. Cl.
*B41M 5/00* (2006.01)
*B41M 5/52* (2006.01)
*B41M 5/50* (2006.01)

(52) U.S. Cl.
CPC ..... *B41M 5/52* (2013.01); *B41M 5/502* (2013.01); *B41M 5/506* (2013.01); *B41M 5/5218* (2013.01); *B41M 5/5254* (2013.01); *B41M 5/5281* (2013.01)

(58) Field of Classification Search
CPC ..... B41M 5/502; B41M 5/506; B41M 5/52; B41M 5/5218; B41M 5/5254
See application file for complete search history.

(56) References Cited

U.S. PATENT DOCUMENTS 4,202,870 A 5/1980 Weber et al.
4,242,271 A 12/1980 Weber et al.
5,955,185 A 9/1999 Yoshino et al.
5,965,252 A 10/1999 Santo et al.
6,342,289 B1 1/2002 Eguchi et al.
7,144,613 B2 12/2006 Eguchi et al.
7,625,614 B2 12/2009 Kamo et al.
7,658,981 B2 2/2010 Teramae
7,846,516 B2 12/2010 Kamo et al.
7,867,586 B2 1/2011 Kamo et al.
8,153,212 B2 4/2012 Hyakuda et al.
8,158,223 B2 4/2012 Hyakuda et al.
8,252,392 B2 8/2012 Oguri et al.
8,486,499 B2 7/2013 Nito et al.
8,524,336 B2 9/2013 Oguri et al.
8,609,209 B2 12/2013 Taguri et al.
8,795,798 B2 8/2014 Oguri et al.
8,846,166 B2 9/2014 Herlambang et al.
2001/0055055 A1 12/2001 Eguchi et al.
2006/0147717 A1 7/2006 Hasegawa et al.
2007/0228005 A1 10/2007 Hasegawa et al.
2009/0022910 A1 1/2009 Teramae
2012/0094039 A1* 4/2012 Taguri ..... B41M 5/502 428/32.24
2015/0174936 A1 6/2015 Noguchi et al.
2015/0174937 A1 6/2015 Oguri et al.
2015/0375553 A1 12/2015 Yumoto et al.

FOREIGN PATENT DOCUMENTS

JP S61-10483 A 1/1986
JP H05-16015 B2 3/1993
JP H07-232473 A 9/1995
JP H08-132731 A 5/1996
JP H09-66664 A 3/1997
JP H09-76628 A 3/1997
JP 2001-162921 A 6/2001
JP 2004-314321 A 11/2004
JP 2006-212994 A 8/2006
JP 2007-045044 A 2/2007
JP 2008-183807 A 8/2008

* cited by examiner

*Primary Examiner* — Betelhem Shewareged
(74) *Attorney, Agent, or Firm* — Fitzpatrick, Cella, Harper & Scinto

(57) ABSTRACT

A recording medium including a substrate and an ink receiving layer on the substrate, the ink receiving layer containing inorganic particles and a water-soluble resin. The recording medium has an HM1 of 40 N/mm$^2$ or less and has a rate of change of HM2 to HM1 of 400% or less. HM1 is a Martens hardness when an indenter is pushed at a 500 mN load over 180 seconds from a surface of the recording medium into a 1 μm depth in a thickness direction thereof. HM2 is a Martens hardness when the indenter is pushed up to a position where the indenter is not in contact with the surface and is then pushed at a 500 mN load over 180 seconds from a pressing starting position into a 1 μm depth in the thickness direction at the same point as that at which the indenter is first pushed.

15 Claims, 2 Drawing Sheets

RECORDING MEDIUM

BACKGROUND OF THE INVENTION

Field of the Invention

The present invention relates to a recording medium.

Description of the Related Art

As recording media on which images are formed with inks, there is known a recording medium having a porous ink receiving layer that is formed from inorganic particles such as silica particles and alumina particles as the main component on a substrate in order to improve ink absorbency.

However, the porous ink receiving layer may crack when a stress is applied. To prevent the ink receiving layer from cracking, Japanese Patent Application Laid-Open No. 2006-212994 discloses an ink jet recording medium including an ink receiving layer that contains polyvinyl alcohol, urethane, and silica and has a dynamic hardness of 9 or more.

SUMMARY OF THE INVENTION

The present invention is a recording medium including a substrate and an ink receiving layer on the substrate. The ink receiving layer contains inorganic particles and a water-soluble resin, the recording medium has an HM1 of 40 $N/mm^2$ or less and has a rate of change of HM2 to HM1 (HM2/HM1×100) of 400% or less, where the HM1 is a Martens hardness when an indenter is pushed at a load of 500 mN over 180 seconds from a surface of the recording medium into a depth of 1 μm in a thickness direction thereof, and the HM2 is a Martens hardness when the indenter is pushed up to a position where the indenter is not in contact with the surface of the recording medium, and then the indenter is pushed at a load of 500 mN over 180 seconds from a pressing starting position into a depth of 1 μm in the thickness direction at the same point as the point at which the indenter is first pushed.

According to the present invention, a recording medium having excellent folding-induced-cracking resistance and ink absorbency can be provided.

Further features of the present invention will become apparent from the following description of exemplary embodiments with reference to the attached drawings.

DESCRIPTION OF THE EMBODIMENTS

Figure 1:
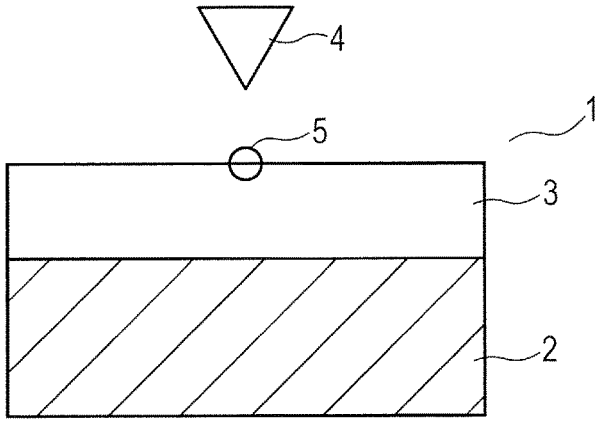
FIG. 1 is a schematic view illustrating the state before the measurement of Martens hardness (HM1) and before an indenter is pushed against the surface of a recording medium.

Preferred embodiments of the present invention will now be described in detail in accordance with the accompanying drawings.

In recent years, favorite photographs or photographs with characters or graphics are printed on recording media having an ink receiving layer on demand, and the printed media are bound into a photo book or a photo album, for example.

In this bookbinding process, the following bookbinding method can be employed: on a recording medium having one printed face, a fold line is made; the recording medium is folded along the fold line in such a way that the printed face is inside; then the other not-printed faces of the recording medium is bonded to that of another recording medium; and consequently the recording media are bound to each other to give a book. This bookbinding method enables the production of photo books and photo albums that can be spread along the fold line as the center and have large photographs or images across pages.

When such a two-page spreadable photo book or photo album is made, an ink receiving layer cracks along the fold line, then the folded area turns white, and the image quality is degraded, in some cases. To address this, there is a need for a recording medium having high folding-induced-cracking resistance.

The inventors of the present invention have examined the recording medium disclosed in Japanese Patent Application Laid-Open No. 2006-212994, but this recording medium has failed to achieve sufficient folding-induced-cracking resistance.

The present invention can provide a recording medium having excellent folding-induced-cracking resistance and ink absorbency.

In the present invention, the ink receiving layer contains inorganic particles and a water-soluble resin. The inventors of the present invention have found that a recording medium further having a particular Martens hardness can achieve sufficient folding-induced-cracking resistance. In other words, the recording medium pertaining to the present invention has a folded area that is unlikely to turn white even when the recording media is folded under load in a bookbinding process and is further repeatedly folded in such a manner as to open and close a photo book, for example.

The relation between the Martens hardness pertaining to the present invention and folding-induced-cracking resistance will be described first.

In the step of folding a recording medium at the time of bookbinding, an ink receiving layer at a folded area is compressed by external stress. By the compression, voids among secondary particles of inorganic particles in the ink receiving layer at the folded area are crushed. This makes the inorganic particles in the ink receiving layer be present more densely, and hardens the ink receiving layer at the folded area. The ink receiving layer in a hardened area is typically likely to become brittle, and thus the ink receiving layer in a fold line area is likely to crack. In other words, it is supposed that when a folded area is released from the compression due to external stress, an ink receiving layer in the folded area exfoliates to expose a substrate, and thus the folded area turns white. Especially for the recording medium used for photo books and albums, it is important that the ink receiving layer in a folded area does not exfoliate even when a photo book or album is opened and closed, or the folded area is repeatedly folded.

Hence, it is essential not to make the ink receiving layer in a folded area to be brittle even when opening and closing (compression and compression release) are repeated, or it is essential that the change in hardness caused by opening and closing (compression and compression release) is small.

The inventors of the present invention have focused attention on the change in hardness at the time of compression of an ink receiving layer and have studied. As a result, the inventors have found the relation between the Martens hardness of an ink receiving layer and the folding-induced-cracking resistance, and have completed the present invention.

Specifically, the Martens hardness when an indenter is pushed at a load of 500 mN over 180 seconds from the surface of a recording medium into a depth of 1 μm in the thickness direction thereof is taken to be HM1. The Martens hardness when the indenter is pushed up to a position where the indenter is not in contact with the surface of the recording medium, and then the indenter is pushed at a load of 500 mN over 180 seconds from a pressing starting position into a depth of 1 μm in the thickness direction at the same point as the point at which the indenter is first pushed is taken to be HM2. In such conditions, it is important that the HM1 is 40 $N/mm^2$ or less and the rate of change of HM2 to HM1 (HM2/HM1×100) is 400% or less in order to achieve excellent folding-induced-cracking resistance.

In order to further improve the folding-induced-cracking resistance, it is preferable that the HM1 be 30 $N/mm^2$ or less. In order to further improve the folding-induced-cracking resistance, it is preferable that the rate of change (HM2/HM1×100) be 350% or less.

Measurement Method of Martens Hardnesses HM1 and HM2

The method of measuring Martens hardnesses HM1 and HM2 in the present invention will next be described.

In the present invention, the Martens hardness is determined in accordance with ISO 14577. In the measurement of Martens hardness in accordance with ISO 14577, a load is applied to an indenter, and the depth and the hardness of a resulting indentation are measured immediately. As a measurement device for measuring the Martens hardness, a Picoindentor (HM500, manufactured by Fischer Instruments Co.) can be used, for example.

The measurement procedure of the Martens hardnesses HM1 and HM2 will be described with reference to FIGS. 1 to 5.

As shown in FIG. 1, a recording medium 1 has a substrate 2 and an ink receiving layer 3. To a pressing starting position (1) on the surface of the recording medium 1 on the side of the ink receiving layer 3, an indenter is pushed down. Then, the indenter is pushed at a load of 500 mN over 180 seconds from the pressing starting position (1) into a depth of 1 μm in the thickness direction of the recording medium shown in FIG. 2. The Martens hardness obtained by this operation is taken to be HM1.

Figure 3:
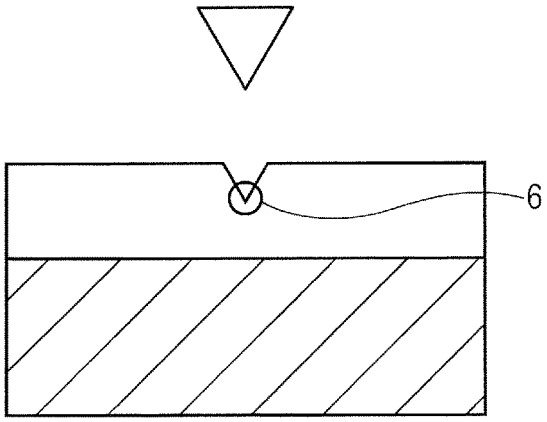
FIG. 3 is a schematic view illustrating the state in which after the measurement of Martens hardness (HM1), the indenter is pushed up to a position where the intender is not in contact with the surface of the recording medium.

Next, after the measurement of the Martens hardness HM1, the indenter is temporarily pushed up to a position where the intender is not in contact with the surface of the recording medium as shown in FIG. 3. Then, the indenter is pushed down once again at the same point as the point at which the indenter is first pushed, and the indenter is pushed once again at a load of 500 mN over 180 seconds from a pressing starting position (2) indicated by '6' in FIG. 3 into a depth of 1 μm shown in FIG. 4. The Martens hardness obtained by this operation is taken to be HM2.

Figure 5:
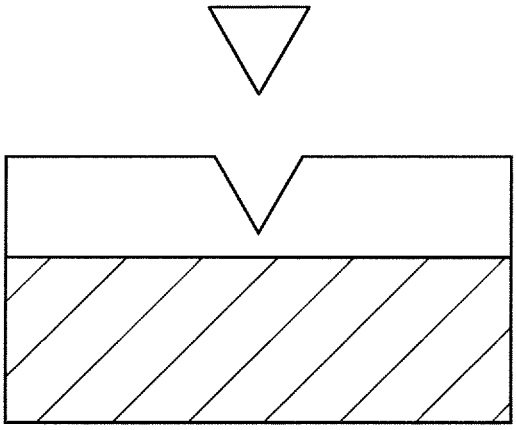
FIG. 5 is a schematic view illustrating the state in which after the measurement of Martens hardness (HM2), the indenter is pushed up to a position where the intender is not in contact with the surface of the recording medium.

After the measurement of the Martens hardness HM2, the indenter is pushed up to a position where the intender is not in contact with the surface of the recording medium as shown in FIG. 5 for unloading.

The present invention will be described in detail hereinafter with reference to preferred embodiments.

Recording Medium

The recording medium of the present invention includes a substrate and an ink receiving layer. In the present invention, an ink jet recording medium used for an ink jet recording method is preferably used.

The respective components constituting the recording medium of the present invention will next be described.

Substrate

As the substrate, papers such as cast-coated paper, baryta paper, and resin-coated paper (resin-coated paper having both faces coated with a resin such as polyolefin) and substrates made of films can be preferably used, for example. As the film, the following transparent thermoplastic resin films can be used, for example.

Polyethylene, polypropylene, polyester, polylactic acid, polystyrene, polyacetate, polyvinyl chloride, cellulose acetate, polyethylene terephthalate, polymethyl methacrylate, and polycarbonate films.

In addition to these substrates, unsized paper and coated paper that have been subjected to appropriate sizing and sheet-like substances composed of a film that is opacified by filling with an inorganic substance or by fine foaming (synthetic paper, for example) can also be used as the substrate. Sheets composed of glass, metal, or a similar material can also be used.

The substrate preferably used for a recording medium to which an image quality and a texture comparable to those of silver halide photography are intended to be imparted is preferably a resin-coated paper having at least one face (surface side) coated with a polyolefin resin on which an ink receiving layer is to be provided. More preferred is a resin-coated paper having both faces coated with a polyolefin resin. One type or two or more types of polyolefin resins can be used as needed. Specifically, a polyethylene is preferably used. As the polyethylene, a low-density polyethylene (LDPE) or a high-density polyethylene (HDPE) is preferably used.

A resin-coat layer may contain a white pigment, a fluorescent brightening agent, ultramarine, and the like in order to control opacity, brightness, or hues. Specifically, a white pigment is preferably contained because the opacity can be improved. The white pigment is exemplified by rutile titanium oxide and anatase titanium oxide. In the present invention, the content of the white pigment in the resin layer is preferably 3 $g/m^2$ or more and 30 $g/m^2$ or less. When the resin layer is provided on both faces of a substrate paper, the total content of the white pigment in the two resin layers preferably meets the above range. From the viewpoint of the dispersion stability of the white pigment, the content of the white pigment in the resin layer is preferably 25% by mass or less relative to the content of a resin.

The thickness of the substrate is not limited to particular values, but is preferably 25 μm or more and 500 μm or less. If having a thickness of 25 μm or more, the substrate can excellently prevent a recording medium from having lower rigidity and excellently suppress disadvantages such as the deterioration of feeling or texture when the recording medium is held by hand and the reduction in opacity. If having a thickness of 500 μm or less, the substrate can excellently prevent a recording medium from having excess rigidity to be difficult to handle and help smooth paper feeding in a printer. The substrate more preferably has a thickness range of 50 μm or more and 300 μm or less. The basis weight of the substrate is not limited to particular values, but is preferably 25 $g/m^2$ or more and 500 $g/m^2$ or less. The substrate used in the present embodiment is preferably a substrate without gas permeability from the viewpoint of surface smoothness.

Ink Receiving Layer

In the present invention, the ink receiving layer contains inorganic particles and a water-soluble resin.

In order to further improve the ink absorbency, the inorganic particles contained in the ink receiving layer are preferably at least one type of inorganic particles selected from alumina particles and silica particles.

In order to further improve the folding-induced-cracking resistance, the ink receiving layer preferably further contains a non-water-soluble resin.

The ink receiving layer preferably has a layer thickness of 15 μm or more and 35 μm or less and more preferably 20 μm or more and 35 μm or less. If the ink receiving layer has a layer thickness within this range, the ink absorbency and the folding-induced-cracking resistance can be more improved.

The ink receiving layer may include a single layer or multilayers.

In the present invention, the ink receiving layer preferably has on the substrate an ink receiving layer (A) and an ink receiving layer (B) in this order in order to improve the color developability and the ink absorbency. The ink receiving layer (B) preferably contains alumina or a gas-phase process silica and a water-soluble resin.

The ink receiving layer (B) preferably has a layer thickness of 1 μm or more and 10 μm or less in order to further improve the ink absorbency and the folding-induced-cracking resistance.

The layer thickness in the present invention is a layer thickness in an absolute dry condition and is the average of four points of cross sections measured with a scanning electron microscope. In the present invention, an object for measuring the layer thickness is quadrangular, and the thicknesses are measured at four points 1 cm apart from four corners in the centroid direction of the quadrangle.

The ink receiving layer of the present invention is a solidified product of a coating solution for forming an ink receiving layer and is formed by applying the coating solution for forming an ink receiving layer onto a substrate and drying the coating. The ink receiving layer may be provided on only one face of a substrate or on both faces.

The constituent materials contained in the ink receiving layer will next be described in detail.

Alumina

The alumina in the present invention is exemplified by γ-alumina, α-alumina, δ-alumina, θ-alumina, χ-alumina, and alumina hydrate. Specifically, γ-alumina and alumina hydrate are preferred from the viewpoint of image density and ink absorbency.

Examples of the γ-alumina include a commercially available gas-phase γ-alumina (for example, trade name: AEROXIDE Alu C, manufactured by EVONIK Co.).

As the alumina hydrate, alumina hydrates represented by General Formula (X) are preferred.

$$Al_2O_3\text{-}n(OH)_{2n}.mH_2O \quad (X)$$

(In the formula, n is any of 0, 1, 2, and 3; m is a value ranging from 0 to 10, preferably from 0 to 5; m and n are not simultaneously 0; m can be an integer or a value that is not an integer because $mH_2O$ represents removable water that does not contribute to the formation of a crystal lattice in many cases; and m may reach a value of 0 when alumina is heated)

As the crystal structure of the alumina hydrate, an amorphous structure, a gibbsite structure, and a boehmite structure are known, and the structure depends on the temperature of heat treatment. An alumina hydrate having any of these crystal structures can be used. Among them, a preferred alumina hydrate is an alumina hydrate having a boehmite structure or an amorphous structure, which is determined by X-ray diffraction analysis. Specifically, the alumina hydrates disclosed in Japanese Patent Application Laid-Open No. H07-232473, Japanese Patent Application Laid-Open No. H08-132731, Japanese Patent Application Laid-Open No. H09-66664, and Japanese Patent Application Laid-Open No. H09-76628 are mentioned. Specific examples of the form of the alumina hydrate used in the present invention include an indefinite form and definite forms such as a spherical form and a plate form. An alumina in an indefinite form or a definite form can be used, and aluminas in an indefinite form and in a definite form can be used in combination. In particular, an alumina hydrate having a number average particle diameter of primary particles of 5 nm or more and 50 nm or less is preferred, and a plate-shaped alumina hydrate having an aspect ratio of 2 or more is preferred. The aspect ratio can be determined by the method disclosed in Japanese Patent Application Laid-Open No. H05-16015. In other words, the aspect ratio is shown by the ratio of "diameter" to "thickness" of a particle. Here, "diameter" is the diameter of a circle having the same area as the projected area of a particle when an alumina hydrate is observed with a microscope or an electron microscope (equivalent circle diameter).

The alumina hydrate can be produced by a known method including a method of hydrolyzing an aluminum alkoxide and a method of hydrolyzing sodium aluminate as disclosed in the specification of U.S. Pat. No. 4,242,271 and the specification of U.S. Pat. No. 4,202,870. The alumina hydrate can also be produced by a known method including a method of neutralization by adding an aqueous solution of aluminum sulfate, aluminum chloride, or the like to an aqueous solution of sodium aluminate or the like. Specific examples of the alumina hydrate used in the present invention include an alumina hydrate having a boehmite structure and an alumina hydrate having an amorphous structure, which are determined by X-ray diffraction analysis. There may be specifically mentioned alumina hydrates disclosed in Japanese Patent Application Laid-Open No. H07-232473, Japanese Patent Application Laid-Open No. H08-132731, Japanese Patent Application Laid-Open No. H09-66664, and Japanese Patent Application Laid-Open No. H09-76628. Specific examples of the alumina hydrate further include a commercially available alumina hydrate (for example, trade name: DISPERAL HP14, manufactured by Sasol Co.).

In the present invention, the alumina preferably has a specific surface area determined by a BET method (BET specific surface area) of 100 $m^2/g$ or more and 250 $m^2/g$ or less and more preferably 125 $m^2/g$ or more and 200 $m^2/g$ or less. Here, the BET method is a method for determining the specific surface area of a sample from an adsorption amount of molecules or ions having a certain size when the molecules or ions are adsorbed onto the sample surface. In the present invention, nitrogen gas is used as the gas to be adsorbed onto a sample.

The alumina and the alumina hydrate may be mixed and used. When mixed, the alumina and the alumina hydrate may be mixed in powder forms and dispersed into a dispersion liquid (sol). Alternatively, an alumina dispersion liquid may be mixed with an alumina hydrate dispersion liquid.

In the present invention, the alumina is preferably dispersed in water, and such a dispersed alumina is preferably used in a coating solution for an ink receiving layer. The alumina in a dispersion state preferably has an average secondary particle diameter of 0.1 nm or more and 500 nm or less, more preferably 1.0 nm or more and 300 nm or less, and particularly preferably 10 nm or more and 250 nm or less. The average secondary particle diameter of inorganic particles in a dispersion state can be determined by dynamic light scattering.

Silica

As the silica in the present invention, a known silica can be used, and a gas-phase process silica is specifically preferred.

The gas-phase process silica is a silica typically produced by burning silicon tetrachloride, hydrogen, and oxygen and is also called dry silica or fumed silica. The gas-phase process silica preferably has a specific surface area determined by the BET method of 50 $m^2/g$ or more and 400 $m^2/g$ or less and more preferably 200 $m^2/g$ or more and 350 $m^2/g$ or less from the viewpoint of ink absorbency, image density, and suppression of cracks at the time of coating and drying. Specific examples of the gas-phase process silica include a commercially available gas-phase process silica (for example, trade name: AEROSIL 300, manufactured by EVONIK Co.).

The gas-phase process silica is preferably mixed with a cationic resin, a polyvalent metal salt, or the like as a dispersant and a mordant and dispersed in water.

Examples of the cationic resin include polyethyleneimine resins, polyamine resins, polyamide resins, polyamide epichlorohydrin resins, polyamine epichlorohydrin resins, polyamide polyamine epichlorohydrin resins, polydiallylamine resins, and dicyandiamide condensates. These cationic resins can be used singly or in combination of two or more of them.

Examples of the polyvalent metal salt include aluminum compounds such as polyaluminum chloride, polyaluminum acetate, and polyaluminum lactate.

In the present invention, the gas-phase process silica is preferably dispersed in water, and such a dispersed gas-phase process silica is preferably used in a coating solution for an ink receiving layer. The gas-phase process silica in a dispersion state preferably has an average secondary particle diameter of 0.1 nm or more and 500 nm or less, more preferably 1.0 nm or more and 300 nm or less, and particularly preferably 10 nm or more and 250 nm or less. The average secondary particle diameter of inorganic particles in a dispersion state can be determined by dynamic light scattering.

Water-Soluble Resin

In the present invention, the water-soluble resin contained in the ink receiving layer is preferably used as a binder resin that can bind inorganic particles and can form a coating.

In the present invention, the water-soluble resin contained in the ink receiving layer is preferably contained in an amount of 35 parts by mass or less and more preferably 30 parts by mass or less relative to 100 parts by mass of the inorganic particles from the viewpoint of ink absorbency. From the viewpoint of folding-induced-cracking resistance, the water-soluble resin is preferably contained in an amount of 5 parts by mass or more and more preferably 10 parts by mass or more relative to 100 parts by mass of the inorganic particles.

When the ink receiving layer includes an ink receiving layer (A) and an ink receiving layer (B), the water-soluble resin contained in the ink receiving layer (A) is preferably contained in an amount of 35 parts by mass or less and more preferably 30 parts by mass or less relative to 100 parts by mass of the inorganic particles from the viewpoint of ink absorbency. From the viewpoint of folding-induced-cracking resistance, the water-soluble resin contained in the ink receiving layer (A) is preferably contained in an amount of 5 parts by mass or more and more preferably 10 parts by mass or more relative to 100 parts by mass of the inorganic particles. The water-soluble resin contained in the ink receiving layer (B) is preferably contained in an amount of 30 parts by mass or less and more preferably 25 parts by mass or less relative to 100 parts by mass of the inorganic particles in the ink receiving layer (B) from the viewpoint of ink absorbency. From the viewpoint of folding-induced-cracking resistance, the water-soluble resin contained in the ink receiving layer (B) is preferably contained in an amount of 5 parts by mass or more and more preferably 10 parts by mass or more.

In the present invention, examples of the water-soluble resin include starch derivatives such as oxidized starch, etherified starch, and phosphorylated starch, cellulose derivatives such as carboxymethyl cellulose and hydroxyethyl cellulose, casein, gelatin, soybean protein, polyvinyl alcohol, polyvinylpyrrolidone, polyacrylic acid, polyacrylamide, polyvinyl acetamide, and derivatives thereof. These resins can be used singly or in combination of two or more of them as needed.

Among these resins, polyvinyl alcohol or a polyvinyl alcohol derivative is preferably used from the viewpoint of suppression of cracks at the time of coating and drying and of film water resistance. Examples of the polyvinyl alcohol derivative include cation-modified polyvinyl alcohols, anion-modified polyvinyl alcohols, silanol-modified polyvinyl alcohols, and polyvinyl acetal. As the cation-modified polyvinyl alcohol, a polyvinyl alcohol having a primary to tertiary amino group or a quaternary ammonium group on the main chain or a side chain of polyvinyl alcohol, as disclosed in, for example, Japanese Patent Application Laid-Open No. S61-10483, is preferred.

The polyvinyl alcohol can be synthesized by saponification of polyvinyl acetate, for example. The polyvinyl alcohol preferably has a saponification degree of 80 mol % or more and 100 mol % or less and more preferably 85 mol % or more and 98 mol % or less. The saponification degree is the proportion of moles of hydroxy groups formed by saponification reaction when polyvinyl acetate is saponified into polyvinyl alcohol, and in the present invention, the value thereof determined by the method in accordance with JIS-K6726 is intended to be used.

The average polymerization degree of the polyvinyl alcohol or the polyvinyl alcohol derivative is preferably 2,500 or more and more preferably 3,000 or more and 5,000 or less. As the average polymerization degree in the present invention, the viscosity average polymerization degree determined by the method in accordance with JIS-K6726 is intended to be used.

The glass transition temperature (Tg) of the polyvinyl alcohol or the polyvinyl alcohol derivative is preferably 40° C. or more. The glass transition temperature is more preferably 70° C. or more and 90° C. or less.

When a coating solution for an ink receiving layer is prepared, the polyvinyl alcohol or the polyvinyl alcohol derivative is preferably used as an aqueous solution. In such a case, the solid content of the polyvinyl alcohol and the polyvinyl alcohol derivative in the aqueous solution is preferably 3% by mass or more and 20% by mass or less.

Non-Water-Soluble Resin

The ink receiving layer preferably contains a non-water-soluble resin. If the ink receiving layer contains a non-water-soluble resin, the receiving layer can be prevented from cracking when a recording medium is folded in half and opening and closing are repeated. The non-water-soluble resin used in the present invention preferably has a cationic surface charge or no surface charge from the viewpoint of the chromogenic properties of inks.

From the viewpoint of the miscibility with a coating solution for an ink receiving layer that is an aqueous solution, an emulsion containing the non-water-soluble resin is preferably mixed with a coating solution for an ink receiving layer to be used.

In the present invention, the non-water-soluble resin contained in the ink receiving layer is preferably present in a form of being dispersed in the ink receiving layer as resin aggregates. In other words, the ink receiving layer preferably has a matrix-domain structure including a matrix portion having a water-soluble resin and a domain portion having a non-water-soluble resin. If the non-water-soluble resin is dispersed in the ink receiving layer as mentioned above, the non-water-soluble resin can more effectively exhibit physical properties thereof in the ink receiving layer. In other words, at the time of compressive deformation of the ink receiving layer by folding of a recording medium, the non-water-soluble resin, of the water-soluble resin and the non-water-soluble resin in the ink receiving layer, is selectively, compressively deformed to relax the compression of the whole ink receiving layer, and thus the ink receiving layer can be prevented from cracking. In addition, by selecting an appropriate particle diameter and elongation, the above compression relaxation effect can be maintained when opening and closing are further repeated, and high folding-induced-cracking resistance can be achieved.

The state of the non-water-soluble resin present in the ink receiving layer can be determined by the following procedure: a cross section sample of an ink receiving layer is prepared by a microtome, for example; and the cross section is observed by using an observation apparatus such as an SEM. For the preparation of a cross section sample, a freezing method such as a cryomicrotome method is preferably used in order to suppress the deformation of a resin or the like as much as possible. The average diameter of resin aggregates (domain portion) of a non-water-soluble resin determined by the cross section observation is substantially the same value as the dispersion particle diameter of the non-water-soluble resin in an emulsion in which the non-water-soluble resin is dispersed as determined by the above dynamic light scattering.

In order to form the distribution of resins in the ink receiving layer as mentioned above, a water-soluble resin and a non-water-soluble resin are preferably used in the ink receiving layer. This is because the water-soluble resin and the non-water-soluble resin have low compatibility with each other and thus phase separation is caused in a coating and drying step of a coating solution for an ink receiving layer when an ink receiving layer is produced. This effect is likely to allow the non-water-soluble resin to be present in a state of being dispersed in the ink receiving layer even at a drying temperature not lower than a minimum film-forming temperature of the non-water-soluble resin. In other words, the matrix-domain structure in which the matrix is a water-soluble resin and the domain is a water-soluble resin is easily formed.

In order to sufficiently achieve the compression relaxation effect by the non-water-soluble resin, the size of resin aggregates of the non-water-soluble resin in the ink receiving layer (average diameter of the domain parts) is preferably 0.3 μm or more. The size of the resin aggregates is substantially the same as the dispersion particle diameter of the non-water-soluble resin in a coating solution for an ink receiving layer. Thus, the non-water-soluble resin in a water-insoluble emulsion is preferably set to have an average dispersion particle diameter of 0.3 μm or more. In order to allow the resin aggregates to efficiently exhibit the compression relaxation effect in the ink receiving layer, the non-water-soluble resin preferably has an elongation at break of 550% or more.

Examples of the non-water-soluble resin include polyester resins; conjugated diene polymers such as styrene-butadiene copolymers, acrylonitrile-butadiene copolymers, and methyl methacrylate-butadiene copolymers; acrylic polymers such as polymers and copolymers of acrylic esters and methacrylic esters; vinyl polymers such as vinyl acetate-maleic ester copolymers, vinyl acetate-ethylene copolymers, vinyl acetate-acrylic copolymers, vinyl acetate-ethylene-acrylic copolymers, and vinyl acetate-vinyl chloride copolymers; modified polymers of these various polymers, containing a functional group such as a carboxy group and cationic groups; and polymers including aqueous adhesives of synthetic resins such as melamine resins, urea resins, and other thermoset resins and including synthetic resin adhesives such as maleic anhydride copolymer resin adhesives, polyacrylamide adhesives, polymethyl methacrylate adhesives, polyurethane resin adhesives, unsaturated polyester resin adhesives, polyvinyl butyral adhesives, and alkyd resin adhesives. From the viewpoint of folding-induced-cracking resistance, polyurethane resins are preferred.

In the present invention, the non-water-soluble resin contained in the ink receiving layer is preferably contained in an amount of 60 parts by mass or less, more preferably 50 parts by mass or less, and even more preferably 40 parts by mass or less relative to 100 parts by mass of the inorganic particles contained in the ink receiving layer from the viewpoint of ink absorbency. From the viewpoint of folding-induced-cracking resistance, the non-water-soluble resin is preferably contained in an amount of 15 parts by mass or more and more preferably 20 parts by mass or more relative to 100 parts by mass of the inorganic particles.

In the present invention, the total content of the water-soluble resin and the non-water-soluble resin contained in the ink receiving layer is preferably 90 parts by mass or less, more preferably 50 parts by mass or less, and even more preferably 45 parts by mass or less relative to 100 parts by mass of the inorganic particles from the viewpoint of ink absorbency. From the viewpoint of folding-induced-cracking resistance, the total content is preferably 20 parts by mass or more and more preferably 25 parts by mass or more relative to 100 parts by mass of the inorganic particles.

Crosslinking Agent

In the present invention, the ink receiving layer may contain a crosslinking agent. If a crosslinking agent is contained, the folding-induced-cracking resistance can be improved. Examples of the crosslinking agent include aldehyde compounds, melamine compounds, isocyanate compounds, zirconium compounds, amide compounds, aluminum compounds, boric acids, and borates. These crosslinking agent can be used singly or in combination of two or more of them as needed. Especially when polyvinyl alcohol or a polyvinyl alcohol derivative is used as the resin, a boric acid or a borate is preferably used among the above crosslinking agents.

The boric acid is exemplified by orthoboric acid (H3BO3), metaboric acid, and hypoboric acid. As the borate, a water-soluble salt of the boric acid is preferred. Examples of the borate include alkali metal salts of boric acids, such as a sodium salt and a potassium salt of boric acids; alkaline earth metal salts of boric acids, such as a magnesium salt and a calcium salt of boric acids; and an ammonium salt of boric acids. Specifically, orthoboric acid is preferably used from the viewpoint of temporal stability of a coating solution and effect of suppressing cracks.

The amount of the crosslinking agent can be appropriately adjusted according to production conditions, for example. In the present invention, the content of the crosslinking agent in the ink receiving layer is preferably 1.0% by mass or more and 50% by mass or less and more preferably 5% by mass or more and 40% by mass or less relative to the content of the water-soluble resin.

When the water-soluble resin is polyvinyl alcohol and the crosslinking agent is at least one compound selected from boric acids and borates, the total content of the boric acid and the borate is preferably 2% by mass or more and 20% by mass or less relative to the content of the polyvinyl alcohol in the ink receiving layer.

In the present invention, the ink receiving layer may contain other additives in addition to the components mentioned above. Specific examples of the additive include pH adjusters, thickeners, flow improvers, antifoaming agents, foam suppressors, surfactants, release agents, penetrants, color pigments, color dyes, fluorescent brightening agents, ultraviolet absorbers, antioxidants, antiseptic agents, antifungal agents, water-proofing agents, dye fixing agents, curing agents, and weather resistant materials.

Undercoating Layer

In the present invention, an undercoating layer may be provided between the substrate and the ink receiving layer in order to improve the adhesion between the substrate and the ink receiving layer. The undercoating layer preferably contains a water-soluble polyester resin, gelatin, and polyvinyl alcohol, for example. The undercoating layer preferably has a layer thickness of 0.01 μm or more and 5 μm or less.

Backcoating Layer

In the present invention, a backcoating layer may be provided on a face of the substrate opposite to the face on which the ink receiving layer is provided, in order to improve handling properties, ease of conveyance, and convey abrasion resistance at the time of continuous printing of stacked sheets. The backcoating layer preferably contains a white pigment and a binder, for example. The layer thickness of the backcoating layer is preferably controlled in such a way as to give a dry coating amount of 0.1 $g/m^2$ or more and 25 $g/m^2$ or less.

Topcoating Layer

In the present invention, a layer containing colloidal silica as the main component may be provided on the surface layer of the ink receiving layer in order to improve the scratch resistance. The colloidal silica preferably has an average particle diameter of 20 nm or more and 200 nm or less. If the colloidal silica has an average particle diameter within this range, the scratch resistance, the glossiness, and the image density can be further improved.

The layer containing colloidal silica as the main component preferably has a dry coating amount of 0.01 g/m or more and 2 $g/m^2$ or less. If the additional inorganic pigment layer has a dry mass of 0.01 $g/m^2$ or more, an appropriate scratch resistance can be achieved, and if the additional inorganic pigment layer has a dry mass of 2 $g/m^2$ or less, the reduction in ink absorbency can be suppressed.

Coating and Drying Method of Coating Solution for Forming Ink Receiving Layer

In the present invention, a coating solution for forming an ink receiving layer is applied and dried to yield an ink receiving layer. For the application of the coating solution for forming an ink receiving layer, a known coating process can be used. Examples of the process include slot die coating, slide bead coating, curtain coating, extrusion coating, air knife coating, roll coating, and rod bar coating. A coating solution for a first ink receiving layer and a coating solution for a second ink receiving layer may be successively applied and dried or may be applied by simultaneous multilayer application. In particular, the simultaneous multilayer application by slide bead coating achieves high productivity and thus is a preferred method.

The drying after coating is performed by, for example, a hot-air drier such as a linear tunnel dryer, an arch drier, an air loop drier, and a sine curve air floating dryer or another dryer such as an IR dryer, a heating dryer, and a microwave dryer.

In the present invention, the presence of inorganic particles in the ink receiving layer provided by the above method can be identified by an elementary analysis such as X-ray photoelectron spectroscopy (XPS) and energy dispersive X-ray analysis (EDX).

EXAMPLES

The present invention will next be described in further detail with reference to examples and comparative examples. The present invention is not intended to be limited to the following examples without departing from the scope of the invention. In the following description in examples, "part" is based on mass unless otherwise noted. Materials of the ink receiving layers and evaluation results of the recording mediums used in the examples and comparative examples are shown in Tables 1 and 2.

Production of Recording Medium

Example 1

Preparation of Substrate

In 100 parts of Laubholz Bleached Kraft Pulp slurry, 20 parts of precipitated calcium carbonate was added, and 2 parts of cationic starch and 0.3 part of alkenylsuccinic anhydride-containing neutral sizing agent were added. The whole was thoroughly mixed to give a paper-making material. The obtained paper-making material was dried by using a Fourdrinier multi-tube type paper machine to a water content of 10%. A 7% solution of oxidized starch was applied to both faces of the paper-making material at 4 $g/m^2$ with a size press, and then the material was dried to a water content of 7%, yielding a substrate paper having a basis weight of 110 $g/m^2$. To both surfaces of the substrate paper, a resin composition containing 20 parts of high-density polyethylene and 70 parts of low-density polyethylene was applied by melt extrusion so as to give a coating amount of 30 $g/m^2$ per face. Immediately after the melt extrusion, cooling rollers with a rough surface were used to perform embossing treatment on the polyethylene surfaces while the substrate paper was being cooled, yielding a substrate having a basis weight of 170 $g/m^2$.

Preparation of Alumina Hydrate Sol

To 333 parts of ion-exchanged water, 1.5 parts of methanesulfonic acid was added as a deflocculating acid to give an aqueous methanesulfonic acid solution. While the aqueous methanesulfonic acid solution was stirred with a homomixer (T.K. Homomixer MARKTI 2.5, manufactured by Tokusyu Kika Kogyo Co.) at a rotation of 3,000 rpm, 100 parts of alumina hydrate (DISPERAL HP14, manufactured by Sasol Co., a specific surface area of 190 $m^2/g$) was slowly added. After the completion of the addition, the mixture was further stirred for 30 minutes, yielding alumina hydrate sol having a solid content concentration of 23.0% by mass.

Preparation of Gas-Phase Process Silica Sol

To 333 parts of ion-exchanged water, 4.0 parts of cationic polymer (SHAROLL DC902P, manufactured by Dai-ichi Kogyo Seiyaku Co.) was added to give an aqueous cationic polymer solution. While the aqueous cationic polymer solution was being stirred with a homomixer (T.K. Homomixer MARKTI 2.5, manufactured by Tokusyu Kika Kogyo Co.) at a rotation of 3,000 rpm, 100 parts of gas-phase process silica (AEROSIL 300, manufactured by EVONIK Co.) was slowly added. After the completion of the addition, the mixture was diluted with ion-exchanged water and treated with a high-pressure homogenizer (Nanomizer, manufactured by Yoshida Kikai Co.) twice, yielding gas-phase process silica sol having a solid content concentration of 20.0% by mass.

Preparation of Aqueous Polyvinyl Alcohol Solution

To 1,150 parts of ion-exchanged water, 100 parts of polyvinyl alcohol (PVA 235, manufactured by Kuraray Co., a saponification degree of 88%, an average polymerization degree of 3,500) as a water-soluble resin was added with stirring. After the completion of the addition, the polyvinyl alcohol was dissolved by heating at 90° C., yielding an aqueous polyvinyl alcohol solution having a solid content concentration of 8.0% by mass.

Preparation of Alumina Coating Solution A for Ink Receiving Layer (A)

The aqueous polyvinyl alcohol solution was mixed with the alumina hydrate sol in such a condition that the solid content of the polyvinyl alcohol was 15 parts relative to 100 parts of alumina solid content contained in the alumina hydrate sol. Next, the mixed liquid was mixed with a urethane resin emulsion (Superflex E2000, manufactured by Dai-ichi Kogyo Seiyaku Co.) in such a condition that the solid content of the urethane resin was 30 parts relative to 100 parts of alumina solid content in the mixed liquid. The polyurethane resin contained in the urethane resin emulsion (Superflex E2000) is a non-water-soluble resin. Next, the resulting mixture was mixed with an aqueous orthoboric acid solution having a solid content concentration of 5% by mass in such a condition that the solid content of orthoboric acid was 0.75 part relative to 100 parts of alumina solid content, giving coating solution A.

Preparation of Silica Coating Solution B for Ink Receiving Layer (A)

The aqueous polyvinyl alcohol solution was mixed with the gas-phase process silica sol in such a condition that the solid content of the polyvinyl alcohol was 25 parts relative to 100 parts of gas-phase process silica solid content contained in the gas-phase process silica sol. Next, the mixed liquid was mixed with a urethane resin emulsion (Superflex E2000, manufactured by Dai-ichi Kogyo Seiyaku Co.) in such a condition that the solid content of the urethane resin was 35 parts relative to 100 parts of gas-phase process silica solid content in the mixed liquid. Next, the resulting mixture was mixed with an aqueous orthoboric acid solution having a solid content concentration of 5% by mass in such a condition that the solid content of orthoboric acid was 3.75 parts relative to 100 parts of gas-phase process silica solid content, giving coating solution B.

Preparation of Alumina Coating Solution C for Ink Receiving Layer (B)

The aqueous polyvinyl alcohol solution was mixed with the alumina hydrate sol in such a condition that the solid content of polyvinyl alcohol was 11 parts relative to 100 parts of alumina solid content contained in the alumina hydrate sol. Next, the mixture was mixed with an aqueous orthoboric acid solution having a solid content concentration of 5% by mass in such a condition that the solid content of orthoboric acid was 1 part relative to 100 parts of alumina solid content, giving coating solution C.

Production of Recording Medium

The coating solution A was applied to one face of the above-mentioned substrate and dried in such a way as to give a thickness of 25 μm after drying, yielding recording medium 1.

Example 2

Recording medium 2 was produced in the same manner as in Example 1 except that the coating solution B was used in place of the coating solution A.

Example 3

Recording medium 3 was produced in the same manner as in Example 1 except that a urethane resin emulsion (BONTIGHTER HUX895, manufactured by ADEKA Co.) was used in place of the urethane resin emulsion (Superflex E2000, manufactured by Dai-ichi Kogyo Seiyaku Co.) in the coating solution A.

Example 4

Recording medium 4 was produced in the same manner as in Example 1 except that the content of the urethane resin emulsion in the coating solution A was changed from 30 parts to 13 parts.

Example 5

Recording medium 5 was produced in the same manner as in Example 1 except that the content of the urethane resin emulsion in the coating solution A for an ink receiving layer (A) was changed from 30 parts to 15 parts.

Example 6

Recording medium 6 was produced in the same manner as in Example 1 except that the content of the urethane resin emulsion in the coating solution A for an ink receiving layer (A) was changed from 30 parts to 60 parts.

Example 7

Recording medium 7 was produced in the same manner as in Example 1 except that the content of the urethane resin emulsion in the coating solution A for an ink receiving layer (A) was changed from 30 parts to 62 parts.

Example 8

Recording medium 8 was produced in the same manner as in Example 1 except that the water-soluble resin in the coating solution A was changed from the polyvinyl alcohol having an average polymerization degree of 3,500 to a polyvinyl alcohol having an average polymerization degree of 1,700.

Example 9

Recording medium 9 was produced in the same manner as in Example 1 except that the water-soluble resin in the coating solution A was changed from polyvinyl alcohol to polyvinyl acetamide (PNVA, manufactured by Showa Denko).

Example 10

Recording medium 10 was produced in the same manner as in Example 1 except that the content of the polyvinyl alcohol in the coating solution A was changed from 15 parts to 3 parts.

Example 11

Recording medium 11 was produced in the same manner as in Example 1 except that the content of the polyvinyl alcohol in the coating solution A was changed from 15 parts to 5 parts.

Example 12

Recording medium 12 was produced in the same manner as in Example 1 except that the content of the polyvinyl alcohol in the coating solution A was changed from 15 parts to 35 parts.

Example 13

Recording medium 13 was produced in the same manner as in Example 1 except that the content of the polyvinyl alcohol in the coating solution A was changed from 15 parts to 37 parts.

Example 14

Recording medium 14 was produced in the same manner as in Example 1 except that the urethane resin emulsion in the coating solution A was changed to an ethylene/vinyl acetate copolymer emulsion (SUMIKAFLEX 201HQ, Sumika Chemtex Co., Ltd.).

Example 15

Recording medium 15 was produced in the same manner as in Example 1 except that the coating solution A was applied in such a way as to give a thickness of 13 μm after drying.

Example 16

Recording medium 16 was produced in the same manner as in Example 1 except that the coating solution A was applied in such a way as to give a thickness of 15 μm after drying.

Example 17

Recording medium 17 was produced in the same manner as in Example 1 except that the coating solution A was applied in such a way as to give a thickness of 35 μm after drying.

Example 18

Recording medium 18 was produced in the same manner as in Example 1 except that the coating solution A was applied in such a way as to give a thickness of 37 μm after drying.

Example 19

Recording medium 19 was produced by applying the coating solution C onto the ink receiving layer of the recording medium 1 produced in Example 1 and drying the coating in such a way as to give a thickness of 1 μm after drying.

Example 20

Recording medium 20 was produced by applying the coating solution C onto the ink receiving layer of the recording medium 1 produced in Example 1 and drying the coating in such a way as to give a thickness of 5 μm after drying.

Example 21

Recording medium 21 was produced by applying the coating solution C onto the ink receiving layer of the recording medium 1 produced in Example 1 and drying the coating in such a way as to give a thickness of 10 μm after drying.

Comparative Example 1

Recording medium 22 was produced in the same manner as in Example 1 except that a urethane resin emulsion (Superfiex M500, manufactured by Dai-ichi Kogyo Seiyaku Co.) was used in place of the urethane resin emulsion (Superflex E2000, manufactured by Dai-ichi Kogyo Seiyaku Co.) in the coating solution A.

Comparative Example 2

Recording medium 23 was produced in the same manner as in Example 1 except that the gas-phase process silica (AEROSIL 300, manufactured by EVONIK Co.) in the coating solution B was changed to a gas-phase process silica (AEROSIL 300SF75, manufactured by Nippon Aerosil Co.), the urethane resin emulsion (Superflex E2000, manufactured by Dai-ichi Kogyo Seiyaku Co.) in the coating solution B was changed to a urethane resin emulsion (SUPERFLEX 650, manufactured by Dai-ichi Kogyo Seiyaku Co.), and the coating solution B was applied in such a way as to give a thickness of 32 μm after drying.

Comparative Example 3

Recording medium 24 was produced in the same manner as in Example 1 except that the content of the urethane resin emulsion in the coating solution A was changed from 30 parts to 0 part, and the content of the polyvinyl alcohol in the coating solution A was changed from 15 parts to 45 parts.

Comparative Example 4

Recording medium 25 was produced in the same manner as in Example 1 except that the content of the polyvinyl alcohol in the coating solution A was changed from 15 parts to 0 part, and the content of the urethane resin emulsion in the coating solution A was changed from 30 parts to 45 parts.

Comparative Example 5

Recording medium 26 was produced in the same manner as in Example 1 except that the gas-phase process silica (AEROSIL 300, manufactured by EVONIK Co.) in the coating solution B was changed to a synthetic amorphous silica (Finesil X37B, manufactured by Tokuyama Co.), and the urethane resin emulsion in the coating solution B was changed to an ethylene/vinyl acetate copolymer emulsion (AM-3100, manufactured by Showa Highpolymer Co.).

Evaluation

In the present invention, a sample having any of evaluation ranks 5 to 2 in each evaluation item was taken to be a preferred level, and a sample having evaluation rank 1 was taken to be an unacceptable level.

Observation of Dispersion State of Non-Water-Soluble Resin in Ink Receiving Layer For the recording media 1 to 21 used in Examples 1 to 21, a cross section sample of the ink receiving layer of each recording medium was prepared by a cryomicrotome method. The obtained cross section sample of the ink receiving layer was observed with an SEM. The matrix-domain structure including a matrix portion having a water-soluble resin and a domain portion having a non-water-soluble resin was observed in each cross section sample.

Each domain part had an average diameter of 0.3 μm or more.

Measurement of Martens Hardness

The obtained recording medium was cut into an A4 size, and a solid black image was printed on the whole area of the recording face by using an ink jet printer (trade name: MP990, manufactured by Canon Co.). At 30 minutes after printing, the Martens hardness of the printed face was measured with a Picoindentor (HM500, manufactured by Fischer Instruments Co.) by the following procedure.

Figure 2:
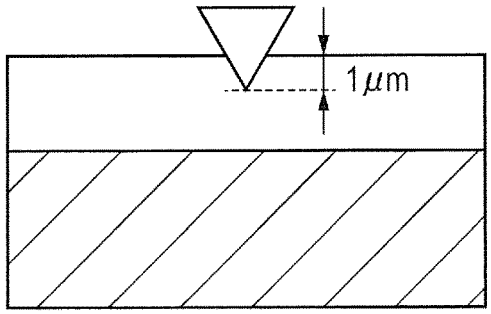
FIG. 2 is a schematic view illustrating the state in which the indenter is pushed from the surface of the recording medium into a depth of 1 μm in the thickness direction thereof for measuring the Martens hardness (HM1).
Figure 4:
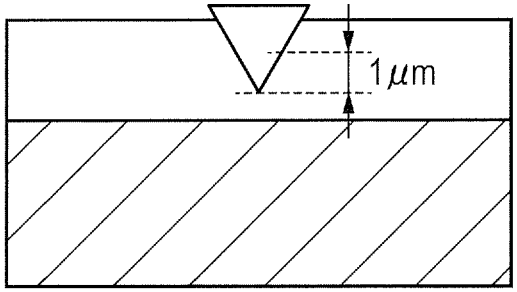
FIG. 4 is a schematic view illustrating the state in which the indenter is pushed into a depth of 1 μm in the thickness direction from a pressing starting position for measuring the Martens hardness (HM2).

In an environment at 23° C. and 50% RH, an indenter having a square pyramid shape (vertex angle: 113°) was pushed at a load of 500 mN over 180 seconds from each surface (pressing starting position (1)) of the recording media 1 to 26 into a depth of 1 μm in the thickness direction, and the Martens hardness (HM1) at a depth of 1 μm from the pressing starting position (1) was measured (FIGS. 1 and 2). Next, the indenter was temporarily pushed up to a position where the intender was not in contact with the surface of the recording medium, and then the indenter having a square pyramid shape (vertex angle: 113°) was pushed once again at a load of 500 mN over 180 seconds from a pressing starting position (2) into a depth of 1 μm in the thickness direction at the same point as the point at which the indenter had been first pushed, and the Martens hardness (HM2) at a depth of 1 μm from the pressing starting position (2) was measured (FIGS. 3 and 4). The pressing starting position (2) was the valley point of the indentation mark formed after the ink receiving layer was released from the first compression by the indenter and sufficiently recovered due to elasticity.

From the obtained Martens hardnesses HM1 and HM2, the rate of change in the Martens hardness (HM2/HM1×100) was calculated. The obtained HM1 and the rate of change in Martens hardness are shown in Table 1.

Folding-Induced-Cracking Resistance at the Time of Repeated Folding

The obtained recording medium was cut into an A4 size, and a solid black image was printed on the whole area of the recording face by using an ink jet printer (trade name: MP990, manufactured by Canon Co.). The printed recording medium was folded in half so that the printed face was inside. A pressing machine was used to apply a load of 500 kg to the folded recording medium, and the load was maintained for 5 minutes. Opening and closing of the recording medium was further repeated 100 times. The folded area was visually observed and evaluated on the basis of the following criteria. The evaluation results are shown in Table 1.

5. No white line is observed.
4. A white line is slightly observed.
3. A white line is observed to some extent.
2. A white line is clearly observed.
1. A bold white line is clearly observed.

Ink Absorbency

On each recording face of the obtained recording media, a solid green image was printed by an ink jet printer (trade name: MP990, manufactured by Canon Co.) with the mode of Photo Paper Gloss Gold and no color correction. The printed area was visually observed and evaluated on the basis of the following criteria. The evaluation results are shown in Table 1.

5: Almost no unevenness is observed in a solid area.
4: Unevenness is slightly observed in a solid area.
3: Unevenness is observed in a solid area to some extent.
2: Marked unevenness is observed in a solid area.
1: Ink overflow is observed in a solid area.

TABLE 1

| | | Ink receiving layer (A) | | | | | | | | |
|---|---|---|---|---|---|---|---|---|---|---|
| | | Inorganic particles | Water-soluble resin | | | Non-water-soluble resin | | | Total content of water-soluble resin and non-water-soluble resin (part) | Layer thickness (μm) |
| | | Product name | Type | Degree of polymerization | Content (part) | Type | Product name | Content (part) | | |
| Example 1 | Recording medium 1 | DISPERAL HP14 | PVA | 3500 | 15 | Urethane | SUPERFLEX E2000 | 30 | 45 | 25 |
| Example 2 | Recording medium 2 | AEROSIL 300 | PVA | 3500 | 25 | Urethane | SUPERFLEX E2000 | 35 | 60 | 25 |
| Example 3 | Recording medium 3 | DISPERAL HP14 | PVA | 3500 | 15 | Urethane | BONTIGHTER HUX895 | 30 | 45 | 25 |

TABLE 1-continued

| | | | | | | | | | | |
|---|---|---|---|---|---|---|---|---|---|---|
| Example 4 | Recording medium 4 | DISPERAL HP14 | PVA | 3500 | 15 | Urethane | SUPERFLEX E2000 | 13 | 28 | 25 |
| Example 5 | Recording medium 5 | DISPERAL HP14 | PVA | 3500 | 15 | Urethane | SUPERFLEX E2000 | 15 | 30 | 25 |
| Example 6 | Recording medium 6 | DISPERAL HP14 | PVA | 3500 | 15 | Urethane | SUPERFLEX E2000 | 60 | 75 | 25 |
| Example 7 | Recording medium 7 | DISPERAL HP14 | PVA | 3500 | 15 | Urethane | SUPERFLEX E2000 | 62 | 77 | 25 |
| Example 8 | Recording medium 8 | DISPERAL HP14 | PVA | 1700 | 15 | Urethane | SUPERFLEX E2000 | 30 | 45 | 25 |
| Example 9 | Recording medium 9 | DISPERAL HP14 | Polyvinyl acetamide | — | 15 | Urethane | SUPERFLEX E2000 | 30 | 45 | 25 |
| Example 10 | Recording medium 10 | DISPERAL HP14 | PVA | 3500 | 3 | Urethane | SUPERFLEX E2000 | 30 | 33 | 25 |
| Example 11 | Recording medium 11 | DISPERAL HP14 | PVA | 3500 | 5 | Urethane | SUPERFLEX E2000 | 30 | 35 | 25 |
| Example 12 | Recording medium 12 | DISPERAL HP14 | PVA | 3500 | 35 | Urethane | SUPERFLEX E2000 | 30 | 65 | 25 |
| Example 13 | Recording medium 13 | DISPERAL HP14 | PVA | 3500 | 37 | Urethane | SUPERFLEX E2000 | 30 | 67 | 25 |
| Example 14 | Recording medium 14 | DISPERAL HP14 | PVA | 3500 | 15 | EVA | SUNIKAFLEX 201HQ | 30 | 45 | 25 |
| Example 15 | Recording medium 15 | DISPERAL HP14 | PVA | 3500 | 15 | Urethane | SUPERFLEX E2000 | 30 | 45 | 13 |
| Example 16 | Recording medium 16 | DISPERAL HP14 | PVA | 3500 | 15 | Urethane | SUPERFLEX E2000 | 30 | 45 | 15 |
| Example 17 | Recording medium 17 | DISPERAL HP14 | PVA | 3500 | 15 | Urethane | SUPERFLEX E2000 | 30 | 45 | 35 |
| Example 18 | Recording medium 18 | DISPERAL HP14 | PVA | 3500 | 15 | Urethane | SUPERFLEX E2000 | 30 | 45 | 37 |
| Example 19 | Recording medium 19 | DISPERAL HP14 | PVA | 3500 | 15 | Urethane | SUPERFLEX E2000 | 30 | 45 | 25 |
| Example 20 | Recording medium 20 | DISPERAL HP14 | PVA | 3500 | 15 | Urethane | SUPERFLEX E2000 | 30 | 45 | 25 |
| Example 21 | Recording medium 21 | DISPERAL HP14 | PVA | 3500 | 15 | Urethane | SUPERFLEX E2000 | 30 | 45 | 25 |
| Comparative Example 1 | Recording medium 22 | DISPERAL HP14 | PVA | 3500 | 15 | Urethane | SUPERFLEX 500M | 30 | 45 | 25 |
| Comparative Example 2 | Recording medium 23 | Aerosil 300SF75 | PVA | 3500 | 15 | Urethane | SUPERFLEX 650 | 30 | 45 | 32 |
| Comparative Example 3 | Recording medium 24 | DISPERAL HP14 | PVA | 3500 | 45 | Urethane | SUPERFLEX E2000 | 0 | 45 | 25 |
| Comparative Example 4 | Recording medium 25 | DISPERAL HP14 | — | — | — | Urethane | SUPERFLEX E2000 | 45 | 45 | 25 |
| Comparative Example 5 | Recording medium 26 | Finesil X378 | PVA | 3500 | 15 | EVA | AM-3100 | 30 | 45 | 25 |

| | | Ink receiving layer (B) | | | | Total layer | Martens hardness | | Evaluation result | |
|---|---|---|---|---|---|---|---|---|---|---|
| | | Inorganic | Water-soluble resin | | Layer | thickness of ink | HM1 | Rate of change | Folding-induced- | |
| | | particles Product name | Type | Content (part) | thickness (μm) | receiving layers (μm) | (N/mm$^2$) | (HM2/HM1) (%) | cracking resistance | Ink absorbency |
| Example 1 | Recording medium 1 | — | — | — | — | 25 | 24 | 140 | 5 | 4 |
| Example 2 | Recording medium 2 | — | — | — | — | 25 | 27 | 170 | 5 | 4 |
| Example 3 | Recording medium 3 | — | — | — | — | 25 | 23 | 400 | 2 | 4 |
| Example 4 | Recording medium 4 | — | — | — | — | 25 | 38 | 390 | 2 | 4 |
| Example 5 | Recording medium 5 | — | — | — | — | 25 | 35 | 380 | 3 | 4 |
| Example 6 | Recording medium 6 | — | — | — | — | 25 | 10 | 130 | 5 | 3 |
| Example 7 | Recording medium 7 | — | — | — | — | 25 | 9 | 100 | 5 | 2 |
| Example 8 | Recording medium 8 | — | — | — | — | 25 | 21 | 150 | 2 | 4 |
| Example 9 | Recording medium 9 | — | — | — | — | 25 | 38 | 380 | 2 | 4 |
| Example 10 | Recording medium 10 | — | — | — | — | 25 | 22 | 130 | 2 | 4 |
| Example 11 | Recording medium 11 | — | — | — | — | 25 | 23 | 140 | 3 | 4 |
| Example 12 | Recording medium 12 | — | — | — | — | 25 | 28 | 250 | 5 | 3 |

TABLE 1-continued

| | | | | | | | | | | |
|---|---|---|---|---|---|---|---|---|---|---|
| Example 13 | Recording medium 13 | — | — | — | — | 25 | 29 | 260 | 5 | 2 |
| Example 14 | Recording medium 14 | — | — | — | — | 25 | 35 | 130 | 2 | 4 |
| Example 15 | Recording medium 15 | — | — | — | — | 15 | 24 | 140 | 5 | 2 |
| Example 16 | Recording medium 16 | — | — | — | — | 15 | 24 | 140 | 5 | 3 |
| Example 17 | Recording medium 17 | — | — | — | — | 35 | 28 | 150 | 3 | 4 |
| Example 18 | Recording medium 18 | — | — | — | — | 37 | 28 | 150 | 2 | 4 |
| Example 19 | Recording medium 19 | DISPERAL HP14 | PVA | 11 | 1 | 26 | 25 | 140 | 5 | 5 |
| Example 20 | Recording medium 20 | DISPERAL HP14 | PVA | 11 | 5 | 30 | 27 | 140 | 5 | 5 |
| Example 21 | Recording medium 21 | DISPERAL HP14 | PVA | 11 | 10 | 35 | 35 | 140 | 3 | 5 |
| Comparative Example 1 | Recording medium 22 | — | — | — | — | 25 | 43 | 310 | 1 | 4 |
| Comparative Example 2 | Recording medium 23 | — | — | — | — | 32 | 38 | 500 | 1 | 4 |
| Comparative Example 3 | Recording medium 24 | — | — | — | — | 25 | 53 | 360 | 1 | 4 |
| Comparative Example 4 | Recording medium 25 | — | — | — | — | 25 | 13 | 130 | 1 | 4 |
| Comparative Example 5 | Recording medium 26 | — | — | — | — | 25 | 43 | 450 | 1 | 4 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-040473, filed Mar. 2, 2015, Japanese Patent Application No. 2015-040474, filed Mar. 2, 2015, and Japanese Patent Application No. 2016-031239, filed Feb. 22, 2016, which are hereby incorporated by reference herein in their entirety.

What is claimed is:

1. A recording medium comprising:

a substrate; and an ink receiving layer on the substrate, the ink receiving layer comprising inorganic particles and a water-soluble resin, wherein the recording medium has (i) an HM1 of 40 $N/mm^2$ or less and (ii) a rate of change of HM2 to HM1 (HM2/HM1×100) of 400% or less, where HM1 is a Martens hardness when an indenter is pushed at a load of 500 mN over 180 seconds from a surface of the recording medium into a depth of 1 μm in a thickness direction thereof, and HM2 is a Martens hardness when the indenter is pushed up to a position where the indenter is not in contact with the surface of the recording medium, and then the indenter is pushed at a load of 500 mN over 180 seconds from a pressing starting position into a depth of 1 μm in the thickness direction at the same point as the point at which the indenter is first pushed.

2. The recording medium according to claim 1, wherein HM1 is 30 $N/mm^2$ or less.

3. The recording medium according to claim 1, wherein the rate of change (HM2/HM1×100) is 350% or less.

4. The recording medium according to claim 1, wherein the ink receiving layer contains a non-water-soluble resin.

5. The recording medium according to claim 4, wherein the non-water-soluble resin is a polyurethane resin.

6. The recording medium according to claim 4, wherein a content of the non-water-soluble resin in the ink receiving layer is 15 parts by mass or more and 60 parts by mass or less relative to 100 parts by mass of the inorganic particles.

7. The recording medium according to claim 4, wherein a total content of the water-soluble resin and the non-water-soluble resin in the ink receiving layer is 20 parts by mass or more and 90 parts by mass or less relative to 100 parts by mass of the inorganic particles.

8. The recording medium according to claim 1, wherein the inorganic particles are at least one type of inorganic particles selected from alumina particles and silica particles.

9. The recording medium according to claim 1, wherein the water-soluble resin is polyvinyl alcohol or a polyvinyl alcohol derivative.

10. The recording medium according to claim 9, wherein the polyvinyl alcohol or the polyvinyl alcohol derivative has an average polymerization degree of 2,500 or more.

11. The recording medium according to claim 1, wherein a content of the water-soluble resin in the ink receiving layer is 5 parts by mass or more and 35 parts by mass or less relative to 100 parts by mass of the inorganic particles.

12. The recording medium according to claim 1, wherein the ink receiving layer contains at least one compound selected from boric acids and borates.

13. The recording medium according to claim 1, wherein the ink receiving layer has a layer thickness of 15 μm or more and 35 μm or less.

14. The recording medium according to claim 1, wherein the ink receiving layer has on the substrate, an ink receiving layer (A) and an ink receiving layer (B) in this order, and the ink receiving layer (B) has a layer thickness of 1 μm or more and 10 μm or less.

15. The recording medium according to claim 4, wherein a cross section of the ink receiving layer has a matrix-domain structure including (1) a matrix portion having the water-soluble resin and (2) a domain portion having the non-water-soluble resin.

* * * * *